United States Patent [19]

Kubota et al.

[11] Patent Number: 4,812,874

[45] Date of Patent: Mar. 14, 1989

[54] IMAGE FORMING APPARATUS CAPABLE OF DESIGNATING AREA TO BE COPIED OF ORIGINAL

[75] Inventors: Atsushi Kubota, Machida; Nobukazu Sasaki, Tokyo; Toshirou Kasamura, Yokohama; Toshihiko Kusumoto, Tokyo; Tatsuya Shiratori, Yokohama; Takashi Ozawa, Ichikawa; Yasuyoshi Yamamoto, Tokyo; Michiro Koike, Kawasaki; Masashi Ohashi; Akiyoshi Kimura, both of Tokyo, all of Japan

[73] Assignee: Canon Kabushiki Kaisha, Tokyo, Japan

[21] Appl. No.: 205,539

[22] Filed: Jun. 13, 1988

Related U.S. Application Data

[63] Continuation of Ser. No. 900,741, Aug. 27, 1986, abandoned.

[30] Foreign Application Priority Data

Aug. 30, 1985 [JP] Japan ..... 60-191416

[51] Int. Cl.[4] ..... G03G 15/00

[52] U.S. Cl. ..... 355/7; 355/4

[58] Field of Search ..... 355/4, 7, 14 R, 14 C, 355/41, 75

[56] References Cited

U.S. PATENT DOCUMENTS

| | | | |
|---|---|---|---|
| 4,215,929 | 8/1980 | Sato et al. | 355/7 |
| 4,582,417 | 4/1986 | Yagasaki et al. | 355/7 |
| 4,615,607 | 10/1986 | Yamagawa et al | 355/4 X |
| 4,720,729 | 1/1988 | Watanabe | 355/14 R |

FOREIGN PATENT DOCUMENTS

| | | | |
|---|---|---|---|
| 81865 | 7/1981 | Japan . | |
| 204066 | 12/1982 | Japan . | |
| 58-190959 | 11/1983 | Japan | 355/4 |
| 59-077768 | 5/1984 | Japan | 355/7 |
| 61-003182 | 1/1986 | Japan | 355/7 |

*Primary Examiner*—Patrick R. Salce
*Assistant Examiner*—Marc S. Hoff
*Attorney, Agent, or Firm*—Fitzpatrick, Cella, Harper & Scinto

[57] ABSTRACT

An image forming apparatus capable of reproducing in different colors a plurality of image areas selected from a plurality of different originals on a single copy sheet.

The apparatus comprises a transparent original holder device on which is placed an original in such a way that the image bearing surface of said original faces downwardly; a first original placement reference indicating device disposed on the transparent original holder device; an original pressure device which is movable between a first position at which the original pressure device covers the transparent original holder device and a second position at which the original pressure device opens the transparent original holder device; an image area designation device which is disposed on the surface of the original pressure device and on which is placed an original with the image bearing surface thereof faced upwardly so as to designate an image area to be copied of the original; a second original placement reference indicating device which is disposed on the surface of the original pressure device and is provided for the image area designation device; and a scanning device for exposing and scanning the original placed on the transparent original holder.

25 Claims, 4 Drawing Sheets

IMAGE FORMING APPARATUS CAPABLE OF DESIGNATING AREA TO BE COPIED OF ORIGINAL

This application is a continuation of application Ser. No. 900,741 filed Aug. 27, 1986, now abandoned.

BACKGROUND OF THE INVENTION

1. Field of the Invention

The present invention relates to an image forming apparatus capable of designating an area to be copied of an original and more particularly a copying apparatus capable of designating an image area to be copied of an original and copying only the designated image area on a copy sheet; that is, a copying apparatus capable of designating an area to be copied.

2. Related background art

Recently the copying apparatus incorporating various functions has been widely used.

One of the new functions of the copying apparatus is to copy the images of a plurality of originals. That is, a plurality of originals are copied on a single copy sheet. For instance, assume that there are two originals bearing different image patterns to be copied. Then, the image pattern of one original is first copied on one major surface of a copy sheet and then the image pattern of the other original is copied on the same major surface of the same copy sheet, whereby the two image patterns of two different originals are copied on the single copy sheet. Thus, the multiple copying operation is accomplished. Such multiple copying operation can be performed by a conventional copying apparatus. That is, with the conventional copying apparatus, it suffices to insert a copy sheet which has the image pattern of a first original and is discharged from a copying apparatus, into the copying apparatus again through a manual copy sheet insertion means or the like so that the image pattern of a second original is copied on the same copy sheet. Meanwhile, there has been designed and constructed a copying apparatus of the type in which when the multiple copying operation is selected by an operation panel, a copy sheet is automatically circulated through the copying apparatus so that predetermined image patterns of a plurality of originals can be copied on a single copy sheet as the originals are replaced one by one. In another conventional copying apparatus, when a plurality of originals(for instance, two originals) are placed upon the original stand of the copying apparatus, the desired image pattern areas of the originals are automatically copied on a single copy sheet even when the originals are replaced.

Another novel function of the copying apparatus is to produce a copy sheet bearing a color image. In such color copying apparatus of the type described, instead of a black color developing device, color (for, instance, red, green and so on) developing devices are used, whereby a color image can be copied. In some color copying apparatus, the black color developing device is replaced by color developing devices. However, in case of a recently developed copying apparatus, in addition to a black-color developing device, color developing devices are already incorporated so that when the color copying is selected by the operation panel, copy sheets bearing a color image are automatically reproduced.

When the above-described multiple-image copying apparatus is combined with the above-described color copying apparatus, thereby may be provided a novel copying apparatus having various functions. In this case, when both the multiple copying operation and the color copying operation are selected, a copy sheets bearing predetermined color images of a plurality of original can be automatically reproduced. When the mode of operation is suitably selected, a copy sheet bearing a black-color image of one original and the desired color image of the other original may be obtained.

A further novel function of the copying apparatus is to designate an area to be copied of an original (or to detect coordinate points) so that only an image in a preselected area of an original is copied. According to a conventional method to carry out such process as described above, a desired image area is selected or designated in terms of X and Y coordinates which are entered by an operation panel. Then, in response to the signals representative of the X and Y coordinates, an array of light-emitting elements disposed in the vicinity of a photosensitive member are partially and time-serially turned on so that an electrostatic image in an undesired area on the photosensitive member is erased, whereby only the desired image area is copied.

Recently, there has been proposed a method in which a desired image area is designated by coordinate position detection elements (so-called digitizer). According to this method, an original is placed upon a digitizer and then a desired image area is pressed so that it is automatically detected. This method is advantageous in that the above-described step for measuring the X and Y coordinates of a desired image area can be eliminated.

When the above-described multiple copying function, the color copying function and the function for designating a desired image area are combined, a multifunctional copying apparatus is obtained. In case of the multiple copying operation, the desired image areas to be copied are different from one original to another so that the originals must be so selected that no desired image areas are overlapped with each other. However, when the function for designating a desired image area is added, the image areas which overlap each other can be eliminated or erased so that only the desired image areas can be reproduced and consequently it is not needed to select the original. It follows therefore that by the combination of the above-described three functions, a copy sheet bearing color multi-image can be obtained from any originals.

So far the trend of the recently developed multifunctional copying apparatus has been described, but even the copying apparatus having the above-described three functions is not satisfactory in practice because of the reasons described below.

When the conventional copying apparatus is used in conjunction with a digitizer, the latter must be disposed independently of the main body of the copying apparatus and the digitizer and the main body of the copying apparatus are electrically interconnected to each other through two signal transmission cables. In case of designating a desired image area, an original is placed on the digitizer and is pressed by an input pen or the like to detect the position of the desired image area. Therefore, the digitizer which has a size greater than a predetermined size (the maximum size of an original which can be copied by the corresponding copying apparatus) must be used so that it is difficult to combine the copying apparatus with the digitizer into a unitary construction. As a result, when it is desired to designate an image area to be copied, an operator must move between the digitizer and the copying apparatus so that the copying operation becomes very cumbersome. In addition, when the operator fails to accurately designate a desired image area, the copying operation step is increased, resulting in further complicated operation. Furthermore, since the digitizer must be installed independently of the copying apparatus, the copying system becomes very expensive.

SUMMARY OF THE INVENTION

The present invention was made to overcome the above and other problems encountered in the prior art copying apparatus and has for its object to provide an image forming apparatus incorporating a device for designating a desired image area of an original which is easy to operate.

To the above and other ends, an image forming apparatus in accordance with the present invention is characterized in that a device for designating a desired image area of an original is incorporated in an original pressure means so that a desired image area to be copied is designated on the original pressure means.

With the copying apparatus in accordance with the present invention, as compared with the conventional copying apparatus, the complicated copying steps resulting from the increase of the functions of the copying apparatus can be simplified and erratic copying operations can be avoided so that the copying apparatus in accordance with the present invention can satisfactorily accomplish its various functions in practice. Furthermore, since the digitizer is incorporated with the original pressure means, the space required for the installation of the copying apparatus can be reduced and the cost of the copying apparatus can be decreased.

DESCRIPTION OF THE PREFERRED EMBODIMENTS

Figure 1:
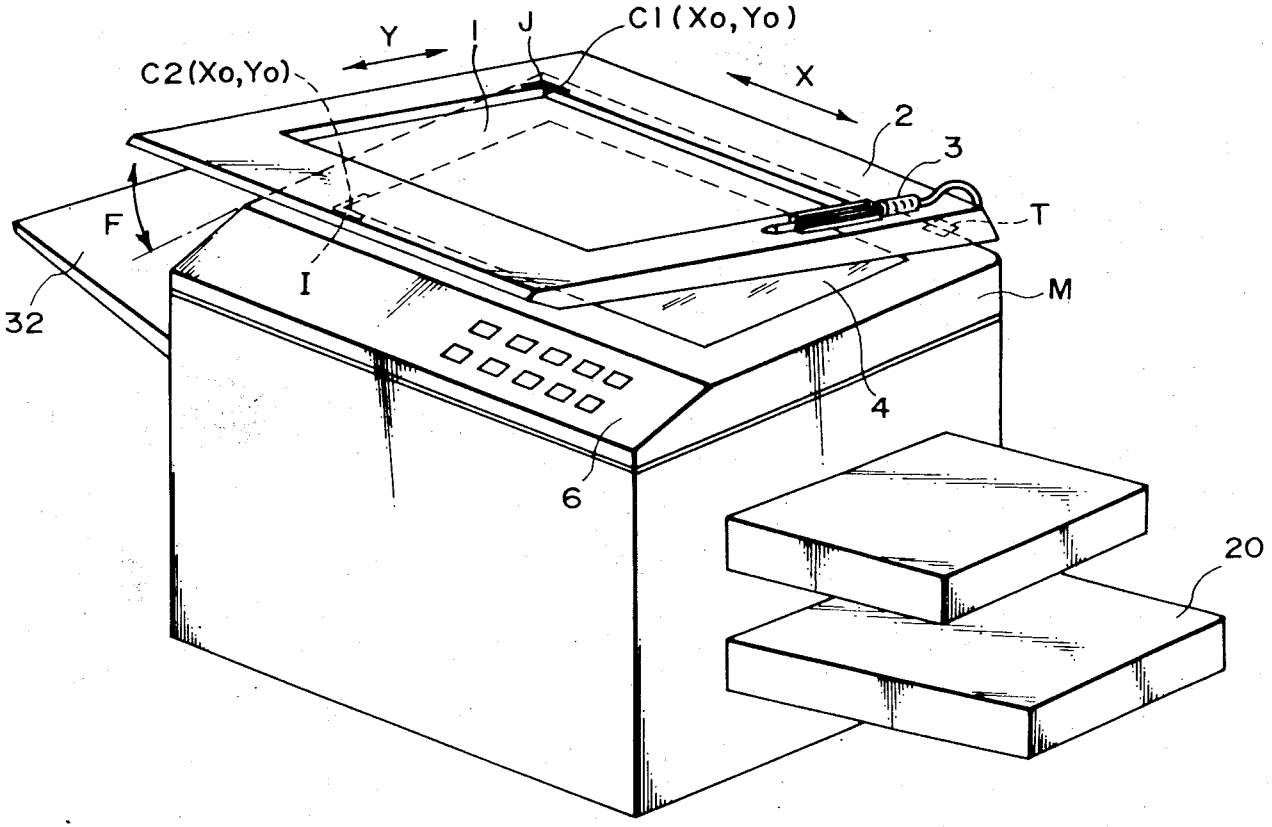
FIG. 1 is a perspective view of a preferred embodiment of the present invention.
Figure 2:
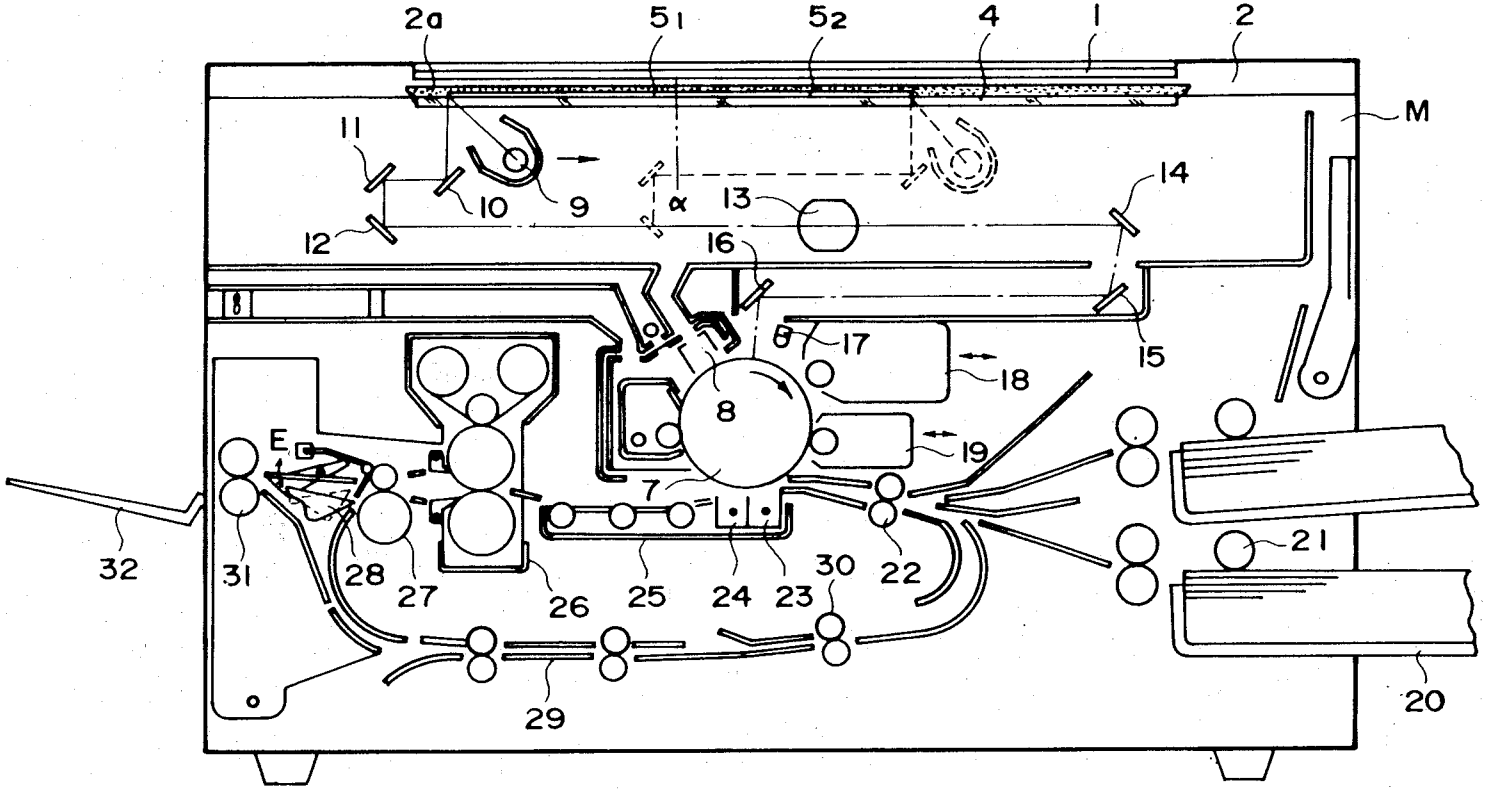
FIG. 2 is a sectional view thereof.

Referring now to FIGS. 1 and 2 a first preferred embodiment of the present invention will be described. M designates a main body of a copying apparatus which is an image forming apparatus. Reference numeral 4 designates an original stand made of glass (original mounting means) which is disposed at the top (the upper side) of the main body M. Numeral 2 designates an original pressure plate hinged to the main body M so that the original pressure plate 2 can be swung in the directions indicated by a double-pointed arrow F. The lower surface of the original pressure plate 2 is lined with an original holding member 2*a* made of a cushion-like material so that when the original pressure plate 2 is closed, the original holding member 2*a* firmly presses an original against the glass original stand 4. Reference numeral 1 designates a digitizer which is a means for designating a desired image area of an original and which is disposed on the top surface of the original pressure plate 2 and is slightly embedded into the original pressure plate 2. The lower surface of the digitizer 1 is substantially coplanar with the upper surface of the glass original stand 4.

As described above, in order to increase its function, the conventional copying apparatus is used in conjunction with the digitizer which must be installed independently of the main body of the copying apparatus. As a result, the copying operation becomes complicated and the function for designating a desired image area to be copied of an original is not satisfactorily accomplished. However, according to the present invention, since the effective area of the digitizer 1 is substantially equal to that of the pressure plate 2, the digitizer 1 is made integrally with the original pressure plate 2. As a result, an operator standing in front of the copying apparatus can accomplish a series of copying steps. In order to designate a desired image area to be copied of an original, an original is placed on the digitizer 1 in such a way that the surface bearing an image pattern of the original faces upwardly and then the original is pressed against the top surface of digitizer 1 by means of an input pen. In case of the copying operation, the original is turned upside down so that the image pattern bearing surface thereof faces downwardly. In case of the conventional copying apparatus with the independently installed digitizer, an operator must carry an original from the digitizer to the copying apparatus so that the operator tends to place the original on the copying apparatus in such a way that the image pattern bearing surface thereof faces upwardly. However, as described above, according to the present invention, a series of copying steps can be accomplished by the operator standing in front of the copying apparatus so that the misplacement of the original on the copying apparatus can be substantially avoided.

Next the step for designating a desired original image area to be copied will be described. First, the original is placed on the digitizer 1 in such a way that the image pattern bearing surface of the original faces upwardly. (In this case, the original pressure plate 2 is closed.) In this case, the original is placed in position in such a way that one corner of the original is abutted against a corner C1 (marked by J) which is the origin $(X_0,Y_0)$ used as a reference point for designating a desired image area of the original. Thereafter, the operator presses an input pen 3 against the original, thereby designating a desired image area to be copied. Next, the original is removed from the digitizer 1 and is turned upside down in the direction Y to be placed upon the glass original stand 4. (In this case, the original pressure plate 2 is opened.) The original stand 4 is marked with a corner $C_2$ (indicated by I) corresponding to the origin $(X_0,Y_0)$ of the digitizer 1. Therefore, when the corner of the original is abutted against the corner $C_2$. the position of the original relative to the copying apparatus is accurately determined. The reference direction perpendicular to the scanning direction is referred to as "the perpendicular reference direction" while the reference direction parallel with the scanning direction is referred to as "the scanning reference direction". The perpendicular direction of the digitizer 1 and the perpendicular reference direction of the original stand are located at one side of the original stand 4 when viewed from the scanning direction. Next, the original pressure plate 2 is closed. In this case, the reference $X_0$ of the corner C1 may be in coincidence with the reference $X_0$ of the corner C2 or may be slightly deviated therefrom.

As described above, according to the present invention, the original can be handled in a simple manner so that the misplacement of an original on the copying apparatus described above with reference to the copying apparatus with the independently installed digitizer may be substantially avoided.

Figure 3B:
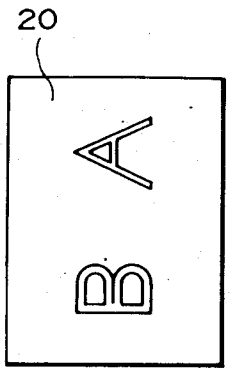
FIG. 3B is a top view of a copy sheet reproduced.
Figure 3A:
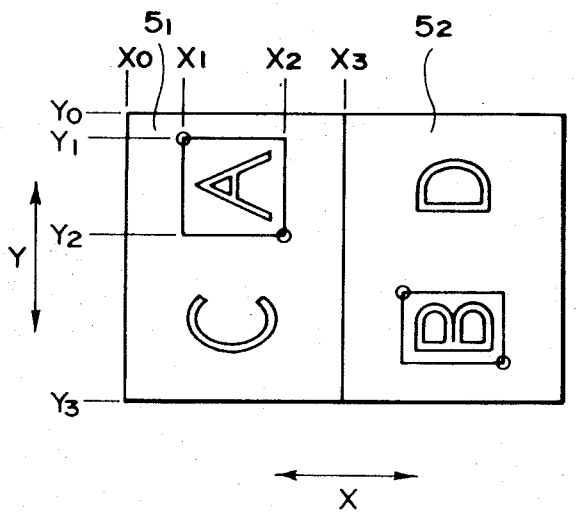
FIG. 3A is a view used to explain the designation of a desired image area of an original.

FIG. 2 is a sectional view of the first embodiment of the present invention shown in perspective view in FIG. 1 and the construction and mode of operation of the first embodiment will be described further in detail with reference to FIGS. 1–3 when a plurality of image patterns from a plurality of originals are reproduced in color on a single copy sheet by designating desired image areas to be copied. An original 5 to be copied comprises original $5_1$ and $5_2$ which have patterns as shown in FIG. 3A. It is assumed that the pattern "A" of the original $5_1$ is selected and copied in black while the pattern "B" of the original $5_2$ is selected and copied in red. To this end, the operator presses a button on an operation panel so that the multi-image copying operation, the color copying operation and the operation for designating a desired image area to be copied may be accomplished simultaneously. Next, the operator pushes a selection button in order that a red image pattern may be obtained in the second copying process. (In general, a black copy is automatically selected in the first copying process, but it is possible to obtain a copy in another color other than black in the first copying process).

The original is first placed on the digitizer 1 as shown in FIG. 3A and the operator presses with the input pen 3 two points $(X_1, Y_1)$ and $(X_2, Y_2)$ which are indicated by white dots and are at the opposite ends, respectively, of a diagonal line, whereby an area A is designated. In a similar manner, the area B of the original $5_2$ is designated. Thereafter, the original $5_1$ and $5_2$ are places on the original stand 4 in juxtaposed relationship with each other in the manner as described above.

Upon depression of the copy-start button on the operation panel 6, a charger 8 uniformly charges the cylindrical surface of a photosensitive drum 7 which rotates in the direction indicated by an arrow (see FIG. 2). Concurrently, a projection system comprising a lamp 9 and mirrors 10, 11 and 12 starts the exposure scanning of the original $5_1$. After scanning the original $5_1$ to the position indicated by the two-dot chain lines $\alpha$, the projection system is returned to its original or home position. The pattern scanned by this projection system is transmitted through a lens 13 and mirrors 14, 15 and 16 to the photosensitive drum 7, whereby the electrostatic image of the original $5_1$ is formed on the cylindrical surface of the photosensitive drum 7. Reference numeral 17 designates an array of light-emitting elements such as LEDs disposed in the direction parallel with the axis of the photosensitive drum 7 (that is, in the direction perpendicular to FIG. 2). In response to the signal for designating a desired image area, the light-emitting elements 17 are partly turned on in the Y direction and time-serially turned on in the X direction in FIG. 3. As a result, the cylindrical surface except the designated image area A of the photosensitive drum is exposed to light so that the area except the desired image area of the cylindrical surface of the photosensitive drum 7 is discharged. This means that even when the original $5_1$ is projected to the cylindrical surface of the photosensitive drum 7, no electrostatic image other than the desired image pattern A is formed (the electrostatic image of the pattern C is not formed). Reference numeral 18 designates a red developing device; and 19, a black developing device. Both the red and black developing devices are so disposed that they move toward or away from the photosensitive drum 7 as indicated by the double-pointed arrows. In FIG. 2, the red developing device 18 is moved away from the photosensitive drum 7 while the black developing device 19 is positioned adjacent to the cylindrical surface of the photosensitive drum 7. Therefore, the electrostatic image of the pattern A is developed in black and the black toner image becomes visible.

Meanwhile, a copy sheet 20 is fed by a feed roller 21 into the copying apparatus and its leading edge is clamped by a pair of register rollers 22. When the leading edge of the original coincides with the leading edge of the copy sheet, the register rollers 22 are rotated so that the copy sheet 20 is fed toward the photosensitive drum 7 so that the black toner image is transferred by a transfer charger 23 on the copy sheet 20, which in turn is separated from the photosensitive drum 7 by means of a separating charger 24. Thereafter, the copy sheet 20 is transferred through a transferring section 25 to a fixer 26, whereby the black toner image is fixed to the copy sheet 20. The copy sheet 20 is transported toward a first copy sheet discharge roller 27, but since the multi-image copying operation is selected, a flapper 28 which is disposed immediately after the roller 27 is brought to the position indicated by the broken lines by a driving means (not shown) so that the copy sheet 20 passes past the first discharge roller 27 and directed by the flapper 28 to a lower copy sheet transportation section 29. When the leading edge of the copy sheet 20 reaches lateral register rollers 30, it is gripped or clamped by the rollers 30 so that the copy sheet 20 is held stationary. At this time, the flapper 28 is returned to its normal position indicated by the solid lines. Concurrently the black developing device 19 is moved away from the photosensitive drum 7 while the red developing device 18 is brought to a position adjacent to the cylindrical surface of the photosensitive drum 7.

Thereafter, the projection system comprising the lamp 9 and the mirrors 10, 11 and 12 are shifted, temporarily stopped at the position $\alpha$ and then displaced again to the position indicated by the broken lines, whereby the exposure scanning of the original $5_2$ is completed. Then, the projection system is returned to its home position indicated by the solid lines. Therefore, the image of the original $5_2$ is projected on the cylindrical surface of the drum 7, but in response to the signal for designating a desired image area to be copied, the light-emitting elements 17 are turned on and off in a manner substantially similar to that described above with reference to the projection of the image of the original $5_1$ on the photosensitive drum 7 so that the electrostatic images of the patterns (in this case, pattern D) is not formed and only the electrostatic image of the pattern B is formed on the cylindrical surface of the photosensitive drum 7. The electrostatic image B on the photosensitive drum 7 is developed by the red developing device 15 while the lateral register rollers 30 are rotated so that the copy sheet 20 is transported toward the register rollers 22. The lateral register rollers 30 are so designed and constructed that while they rotate, they are shifted in the direction perpendicular to the direction in which the copy sheet 20 is transported. Therefore, while the copy sheet 20 is fed by the lateral register rollers 30 toward the register rollers 22. It is displaced in the direction perpendicular to the direction in which the copy sheet 20 is transported, whereby the position of the copy sheet 20 in the direction perpendicular to the direction in which the copy sheet 20 is transported is corrected to become the same as that when the original $5_1$ is projected on the photosensitive drum 7. Thereafter, the red toner image is transferred to the copy sheet 20 in a manner substantially similar to that described above with reference to the reproduction of the pattern A on the original $5_1$ and after passing past the first discharge roller 27, the copy sheet 20 is guided by the upper edge of the flapper 28 which is held in position indicated by the solid lines, toward a pair of second discharge rollers 31 from which the copy sheet 20 is discharged into a tray 32. Thus, multi-color images as shown in FIG. 3B are reproduced on the copy sheet 20.

Figure 4:
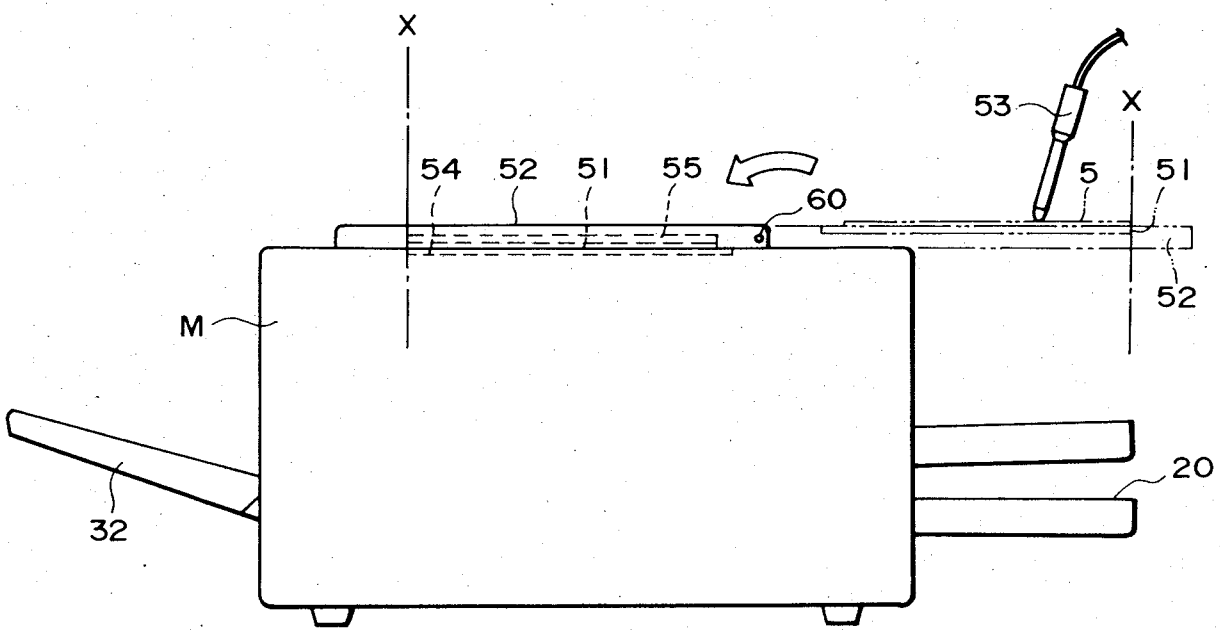
FIG. 4 is a front view of another preferred embodiment of the present invention.

Next, referring to FIG. 4, the second embodiment of the present invention which can facilitate further the operation for designating a desired image area to be copied of an original will be described. Furthermore, with the second embodiment, the chance of misplacing an original on the original stand can be further reduced. While in the first embodiment shown in FIG. 1, the digitizer 1 is disposed on the upper surface (upper side) of the original pressure plate 2; that is, on the surface opposite to the surface which presses the original, in the second embodiment, a digitizer 51 is mounted on the undersurface of an original pressure plate 52.

The mode of operation of the second embodiment is as follows. First, the original pressure plate 52 is swung to the position indicated by the two-dot chain lines so that the digitizer 51 faces upwardly. Then an original 5 is placed on the digitizer 51 in such a way that the image bearing surface of the original faces upwardly and that the lateral direction (right-to-left direction) coincides with the X reference direction. The above-described positioning of the original 5 on the digitizer 51 is substantially similar to that described above with reference to the first embodiment. Thereafter, the operator uses an input pen 53 to press the original 5, thereby designating a desired original image area to be copied. Next the original 5 is swung in the direction indicated by an arrow (so that the original 5 is turned upside down in the X direction) so that the original 5 is placed on a glass original stand 54 in such a way that the image bearing surface of the original 5 faces downwardly. Thereafter, an original pressure plate 54 is caused to swing in the direction indicated by an arrow about a shaft 60. Then, the copying operation is started. As described above, the reference direction perpendicular to the scanning direction is referred to as "the perpendicular reference direction" while the reference direction in parallel with the scanning direction is referred as "the scanning reference direction". Both the perpendicular reference direction of the digitizer 51 and the perpendicular reference direction of the glass original stand 54 are located at one side of the glass original stand 54 when the pressure plate is closed.

As described above, contrary to the first embodiment described above with reference to FIG. 1, according to the second embodiment, it is not needed to turn the original upside down in the Y direction so that the coordinate reference of the digitizer 52 and the coordinate reference of the glass original holder 54 are located in the same direction when the original pressure plate 52 is closed. As a consequence, the misplacement of an original and the erratic designation of a desired image area to be copied can be reduced.

When the digitizer 51 is so designed and constructed that it can electrostatically draw an original, the original pressure plate 52 together with the original can be swung and closed, after the designation of a desired image area to be copied by means of the input pen 53, as indicated by an arrow so that the copying operation can be started immediately. Therefore, the erratic placement of the original can be further reduced so that the copying efficiency can be enhanced.

The digitizer 51 is attached through a cushion 55 (an elastic member such as a spring, sponge or the like) to the original pressure plate 52 so that when the pressure plate 52 is closed, the original can be uniformly pressed against a glass platen.

What is claimed is:

1. An image forming apparatus, comprising:

a main body including means for forming an image of an original;

transparent original placing means, disposed on an upper surface of said main body, for supporting the original thereon;

original pressing means movable between a closed position where said pressing means covers said original placing means and an open position where said pressing means is apart from said original placing means, wherein said original pressing means presses the original placed on said original placing means when at its colored position;

image are designated means disposed on said original pressing means, for designated an image area corresponding to an area on the image bearing surface of the original placed with the image bearing surface thereof facing upwardly;

first original placing position indicating means, provided on said original pressing means, for indicating a position for the original to be placed on said image area designating means for a designating operation; and second original placing position indicating means for indicating a position for the original to be placed on said original placing means with its image bearing surface facing downward for an image forming operation.

2. An image forming apparatus according to claim 1, wherein said first and second original placing position indicating means indicate the positions where at least one edge of the original is to be placed, respectively.

3. An image forming apparatus according to claim 2, wherein said first and second original placing position indicating means indicate the placing positions for the same edge of the original.

4. An image forming apparatus according to claim 1, wherein the surface of said original pressing means for pressing the original is on the opposite side of the surface of said image area designating means on which the original is placed.

5. An image forming apparatus according to claim 4, wherein said first and second original placing position indicating means indicate the positions where at least one edge of the original is to be placed, respectively.

6. An image forming apparatus according to claim 4, wherein said first and second original placing position indicating means indicate the placing positions for the same edge of the original.

7. An image forming apparatus according to claim 4, wherein said image area designation means designates an undesired image area of an original and wherein said image forming means is provided with means responsive to the signal representative of said designated undesired image area for reproducing an image excluding said designated undesired image area.

8. An image forming apparatus according to claim 7, wherein said image forming means comprises a photosensitive medium upon which the image of an original is formed and a light-emitting means which is selectively turned on in response to the designation of a desired image area of an original by said image area designation means, thereby partially erasing the image of the original formed on said photosensitive medium.

9. An image forming apparatus according to claim 4, wherein said image area designation means designates only a desired image area of an original and wherein said image forming means is provided with means responsive to the signal representative of said designated desired image area for reproducing only an image of said designated desired image area.

10. An image forming apparatus according to claim 9, wherein said image forming means comprises a photosensitive medium upon which the image of an original is formed, and a light-emitting means which is selectively turned on in response to the designation of a desired image area of an original by said image area designation means, thereby partially erasing the image of the original formed on said photosensitive medium.

11. An image forming apparatus according to claim 1, wherein said image area designating means is disposed on the surface of said original pressing means for pressing the original.

12. An image forming apparatus according to claim 11, wherein the surface of said original placing means for placement of the original faces and meets the surface of said image area designating means for placement of the original when said original pressing means is at its closed position.

13. An image forming apparatus according to claim 12, wherein the original placing position indicated by said first original placing position indicating means is coincident with that of the second original placing position indicating means when said original pressing means is located at its closed position.

14. An image forming apparatus according to claim 1, wherein said image area designation means designates an undesired image area of the original and wherein said image forming means is provided with means responsive to a signal representative of the undesired image area for reproducing an image excluding said designated undesired image area.

15. An image forming apparatus according to claim 14, wherein said image forming means comprises a photosensitive medium upon which the image of an original is formed, and a light-emitting means which is partially turned on in response to the designation of a desired image area by said image area designation means, thereby partially erasing the formed image.

16. An image forming apparatus according to claim 15, wherein said image forming means causes a designated image area of a first original and a designated image area of a second original to be reproduced on a single copy sheet.

17. An image forming apparatus according to claim 16, wherein said image forming means forms image patterns in different colors on a single copy sheet.

18. An image forming apparatus according to claim 1, wherein said image area designation means designates only a desired image area of an original and wherein said image forming means is provided with means responsive to a signal representative of the designated desired image area for reproducing only said designated desired image area.

19. An image forming apparatus according to claim 18, wherein said image forming means comprises a photosensitive medium upon which the image of the original is formed, and a light-emitting means which is partially turned on in response to the designation of a desired image area by said image area designation means, thereby partially erasing the formed image.

20. An image forming apparatus according to claim 19, wherein said image forming means causes a designated image area of a first original and a designated image area of a second original to be reproduced on a single copy sheet.

21. An image forming apparatus according to claim 20, wherein said image forming means forms image patterns in different colors on a single copy sheet.

22. An image forming apparatus, comprising:

a main body including means for forming an image of an original;

transparent original holder means, disposed at an upper portion of said main body, for supporting an original thereon;

first original placement reference indicating means for indicating a placement position of the original to be placed on said transparent original holder means;

original pressure means movable between a closed position at which one surface of said original pressure means covers said transparent original holder means and an open position at which said original pressure means is apart from said transparent original holder means;

image area designating means, attached to said one surface of said original pressure means, for designating a desired image area of an image bearing surface of the original placed with the image bearing surface thereof facing upwardly when said original pressure means is at its open position, and for pressing the image bearing surface of the original, which original is turned upside down, against the transparent original holder means;

second original placement reference designating means, attached to said one surface of said original pressure means, for indicating a reference position of the original and associated with said image area designation means; and means attached to said one surface of said original pressure means for holding the original in such a way that said original pressure means can be closed while the original is on said image are designation means.

23. An image forming apparatus comprising:

a main body including means for forming an image of an original;

transparent original placing means, disposed at an upper portion of said main body, for supporting an original thereon;

an original pressing member for pressing the original placed on said original placing member;

a plate member pivotally mounted on said main body and supporting said original pressing member on one side thereof;

an image area designating means provided on the opposite side of said plate member, for designating an image area corresponding to an area on the image bearing surface of the original placed with the image bearing surface thereof facing upwardly;

first original placing position indicating means, provided on said plate member, for indicating a position for the original to be placed on said image area designating means; and second original placing position indicating means for indicating a position for the original to be placed on said original placing means with its image bearing surface facing downward for an image formed operation.

24. An image forming apparatus according to claim 23, wherein said first and second original placing position indicating means indicate the positions where a corner of the original and the edges thereof adjacent to said corner are to be placed, respectively.

25. An image forming apparatus according to claim 24, wherein said first and second original placing position indicating means indicate the placing positions for the same corner of the original.

* * * * *

UNITED STATES PATENT AND TRADEMARK OFFICE

CERTIFICATE OF CORRECTION

PATENT NO. : 4,812,874

DATED : March 14, 1989

INVENTOR(S) : ATSUSHI KUBOTA, ET AL.

It is certified that error appears in the above-identified patent and that said Letters Patent is hereby corrected as shown below:

COLUMN 2

Line 3, "copy sheets" should read --copy sheet--.
Line 5, "original" should read --originals--.

COLUMN 5

Line 34, "places" should read --placed--.

COLUMN 6

Line 28, "directed" should read --is directed--.
Line 58, "15" should read --18--.
Line 63, "transported. Therefore," should read --transported, therefore,"--.

COLUMN 8

Line 25, "colored position;" should read --closed position;--.
Line 26, "image are designated means" should read --image area designating means--.
Line 27, "designated" should read --designating--.

COLUMN 10

Line 49, "are" should read --area-.

UNITED STATES PATENT AND TRADEMARK OFFICE

CERTIFICATE OF CORRECTION

PATENT NO. : 4,812,874

DATED : March 14, 1989

INVENTOR(S) : ATSUSHI KUBOTA, ET AL.

It is certified that error appears in the above-identified patent and that said Letters Patent is hereby corrected as shown below:

COLUMN 11

Line 6, "formed" should read --forming--.

Signed and Sealed this

Twenty-seventh Day of March, 1990

*Attest:*

JEFFREY M. SAMUELS

*Attesting Officer*

*Acting Commissioner of Patents and Trademarks*